US007029042B2

(12) United States Patent
Belchine, III

(10) Patent No.: US 7,029,042 B2
(45) Date of Patent: Apr. 18, 2006

(54) AUTOMOBILE DOOR HANDLE

(75) Inventor: Walter Belchine, III, Plainfield, IL (US)

(73) Assignee: Illinois Tool Works Inc, Glenview, IL (US)

( * ) Notice: Subject to any disclaimer, the term of this patent is extended or adjusted under 35 U.S.C. 154(b) by 1 day.

(21) Appl. No.: 10/762,434

(22) Filed: Jan. 22, 2004

(65) Prior Publication Data

US 2005/0161959 A1 Jul. 28, 2005

(51) Int. Cl.
*E05B 3/00* (2006.01)

(52) U.S. Cl. ..... 292/336.3; 292/230; 292/234; 292/238; 292/347; 292/DIG. 22; 292/DIG. 23; 292/DIG. 65

(58) Field of Classification Search ..... 292/336.3, 292/347, DIG. 22, DIG. 23, DIG. 65, 230, 292/234, 238
See application file for complete search history.

(56) References Cited

U.S. PATENT DOCUMENTS

| | | | | | |
|---|---|---|---|---|---|
| 2,864,641 | A * | 12/1958 | Leslie | 292/336.3 |
| 3,159,415 | A * | 12/1964 | Sandor | 292/336.3 |
| 3,191,979 | A * | 6/1965 | Trudeau | 292/336.3 |
| 3,719,248 | A * | 3/1973 | Breitschwerdt et al. | 180/271 |
| 3,799,596 | A * | 3/1974 | Nozomu et al. | 292/216 |
| 5,669,642 | A * | 9/1997 | Kang | 292/336.3 |
| 6,042,159 | A * | 3/2000 | Spitzley et al. | 292/216 |
| 6,218,933 | B1 * | 4/2001 | Josserand et al. | 340/426.28 |
| 6,363,577 | B1 * | 4/2002 | Spitzley | 292/336.3 |
| 6,382,688 | B1 * | 5/2002 | Agostini | 292/336.3 |
| 6,447,030 | B1 * | 9/2002 | Meinke | 292/347 |
| 6,471,262 | B1 * | 10/2002 | Schwab | 292/336.3 |
| 6,565,134 | B1 * | 5/2003 | Stuart et al. | 292/336.3 |
| 6,612,630 | B1 * | 9/2003 | Meinke | 292/348 |
| 6,709,033 | B1 * | 3/2004 | Jooss et al. | 292/336.3 |
| 2003/0155780 | A1 * | 8/2003 | Bucker et al. | 292/336.3 |
| 2005/0012345 | A1 * | 1/2005 | Saitoh | 292/336.3 |

FOREIGN PATENT DOCUMENTS

| | | |
|---|---|---|
| DE | 3324162 | * 10/1985 |
| DE | 19858416 | * 6/2000 |

* cited by examiner

*Primary Examiner*—Brian E. Glessner
*Assistant Examiner*—Carlos Lugo
(74) *Attorney, Agent, or Firm*—Mark W. Croll; Paul F. Donovan

(57) ABSTRACT

An automobile door handle mechanism has a door handle with a handle arm and a latch lever with a lever arm moved by the handle in an unlatch direction to unlatch a door. The handle arm and lever arm overlap in the unlatch direction to restrict movement of the latch lever in the unlatch direction without movement of the handle.

17 Claims, 2 Drawing Sheets

AUTOMOBILE DOOR HANDLE

FIELD OF THE INVENTION

The present invention relates generally to automobile door handle mechanisms and, more particularly, the invention pertains to door handle mechanisms having latch levers with low centers of gravity and pivotal axis spaced from the center of gravity.

BACKGROUND OF THE INVENTION

Exterior door handle mechanisms for automobiles are provided in a variety of designs so that the shape and operation thereof complements and adds to the overall design and appearance of the automobile. In a known design, a horizontal handle is provided at or recessed into the exterior door panel. The handle has a substantially vertical pivotal axis near one end thereof. To actuate the latch mechanisms and unlatch the door, the handle is pulled, pivoting on the axis. When the handle is released, a spring assists in returning the door handle to the closed position.

The door handle is connected to a latch lever in the door interior. The latch lever is connected to a latch cable that is also connected to the latch mechanism designed to secure the door in a closed position. In a known design for the latch lever, the lever pivots about a substantially horizontal axis. The latch lever has a center of gravity spaced significantly below the lever pivot axis. The lever is rotatable about the pivotal axis, and biased by a spring such that, when the door handle is released, the latch lever is returned to a lowered position which places the cable in position for the latch mechanism to be secured, holding the door closed and latched.

In spite of the biasing influence of the spring, a side impact on a vehicle having such a latch mechanism can cause movement of the latch lever on the opposite side of the automobile from the side impact. A significant side impact can cause the latch lever to move to the unlatch position, potentially causing the door on the opposite side from the impact to unlatch, possibly, allowing the door to swing open. Strengthening the spring that biases the latch lever to the closed position can improve the resistance to inadvertent opening during a side impact; however, a stronger spring can make the latch mechanism objectionably difficult to operate.

What is needed is a latch mechanism having a latch lever that is further restricted from rotating about its pivotal axis when the door handle is in a closed position.

SUMMARY OF THE INVENTION

The present invention further limits rotation of the latch lever by providing a rib on the latch lever and a rib on the door handle that overlap, such that, with the door handle in the lowered or closed position, the ribs of the door handle and latch lever interfere if the latch lever tends to move towards an unlatched position.

In one aspect thereof, the present invention provides an automobile door handle mechanism with a door handle having a handle arm and a latch lever having a lever arm engaged with the handle arm for movement of the latch lever by movement of the handle. The latch lever moves about a latch lever axis. A rib on the handle arm and a protrusion on the lever arm restrict movement of the latch lever about the lever axis without movement of the handle.

In another aspect thereof, the present invention provides an automobile door handle mechanism with a handle mechanism base, a handle pivotally connected to the base about a handle axis, and a latch lever pivotally connected to the base about a lever axis. The handle includes a handle arm, and the latch lever includes a lever arm engaged with the handle arm for movement of the latch lever upon movement of the handle. The handle arm and the lever arm are configured and engaged to inhibit rotation of the latch lever without movement of the handle.

In still another aspect thereof, the present invention provides an automobile door handle mechanism with a door handle having a handle arm and a latch lever rotatable in an unlatch direction to unlatch a door. The latch lever has a lever arm engaged with the handle arm for rotation thereof in the unlatch direction by movement of the handle. The handle arm at least partly overlaps the lever arm in the unlatch direction for restricting movement of the latch lever in the unlatch direction without movement of the handle.

An advantage of the present invention is providing an automobile door handle mechanism that inhibits unintended door openings from side impact collisions of the automobile.

Another advantage of the present invention is providing a door handle mechanism of increased security with simple modifications that can be incorporated in existing designs.

Still another advantage of the present invention is providing a door handle mechanism with improved security wherein the parts can be manufactured in a cost efficient manner through casting and the like.

Other features and advantages of the invention will become apparent to those skilled in the art upon review of the following detailed description, claims and drawings in which like numerals are used to designate like features.

Figure 1:
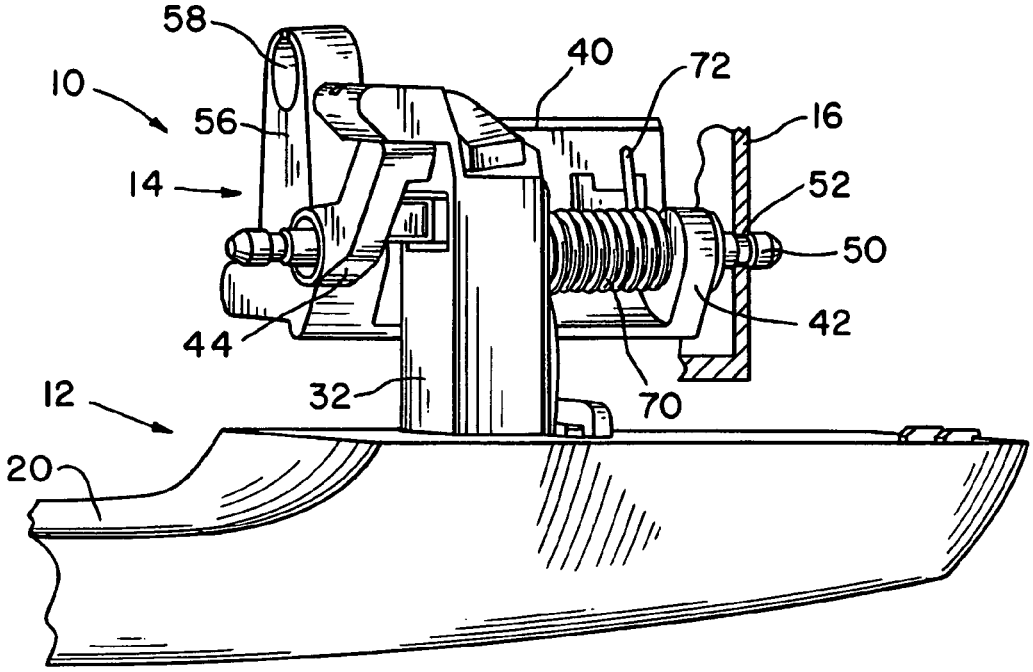
FIG. 1 is a fragmentary perspective view of a door handle mechanism in accordance with the present invention.
Figure 2:
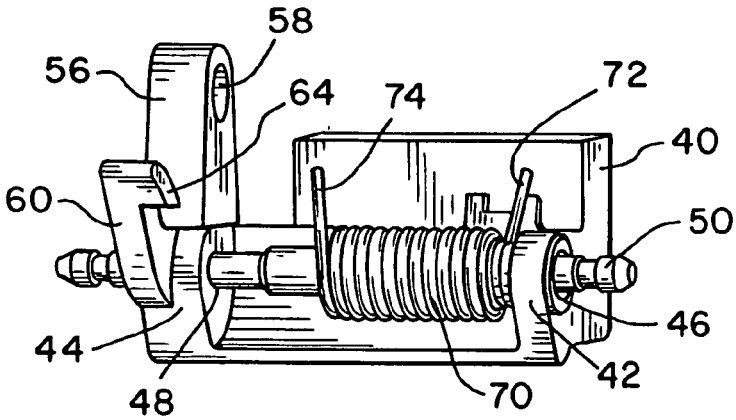
FIG. 2 is a perspective view of the latch lever in the door handle mechanism shown in FIG. 1.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, a door handle mechanism 10 in accordance with the present invention is shown. Door handle mechanism 10 includes a handle 12 and a latch lever 14 each operationally mounted in a base 16. Door handle mechanism 10 is installed in an automobile vehicle door (not shown), with latch lever 14 disposed within the door, between interior and exterior panels thereof. Handle 12 is disposed on the outer surface of the door, either slightly outwardly from or flush with an outer panel of the door (not shown). Those skilled in the art will readily understand that the shape and configuration of door mechanism 10 may change from on vehicle body style to another; however, the general operating principles thereof, to be described hereinafter, are advantageously applied to a variety of designs for door handle mechanism 10.

Base 16 is shown only fragmentally in FIG. 1, and, as known to those skilled in the art, is configured to hold handle 12 and latch lever 14 and to be secured to the automobile door. Door handle 12 is connected to base 16 and latch lever 14 such that movement of handle 12 causes movement of latch lever 14. Latch lever 14 is pivotally connected to base 16, and is connected by a cable or other device (not shown) to the latch that secures the door in a closed position. Movement of handle 12 moves lever 14 such that the cable or other structure (not shown) moves the latch mechanism (not shown) to the unlatched position, allowing the door to be opened. With each handle 12 and latch lever 14 connected to base 16, the parts can be pre-assembled, and the completed assembly thereof subsequently mounted in the automobile door. The cable (not shown) is then connected to latch lever 14.

Figure 3:
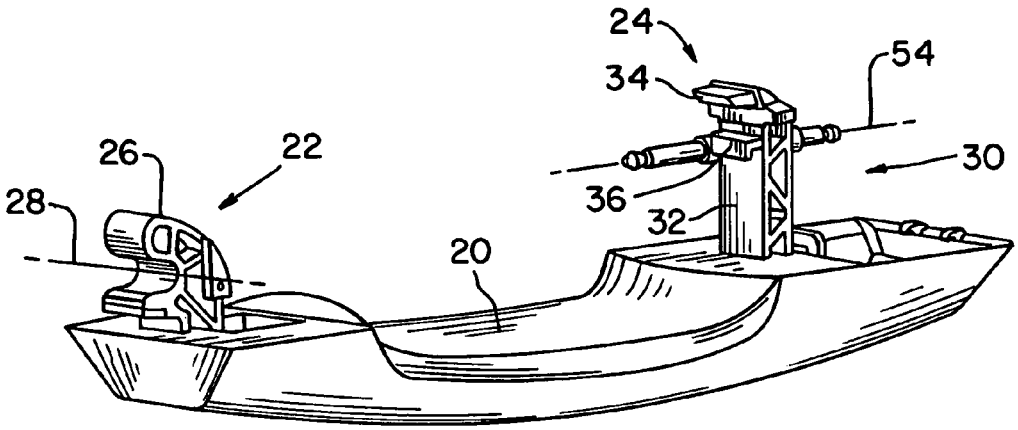
FIG. 3 is a perspective view of the door handle in the door handle mechanism shown in FIG. 1.
Figure 4:
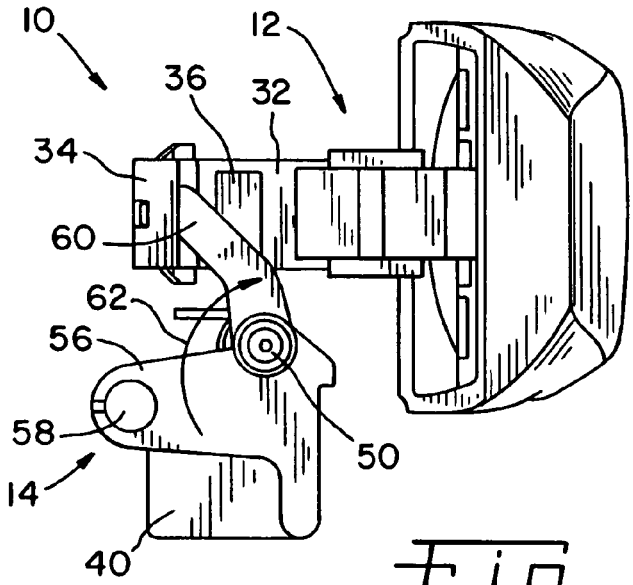
FIG. 4 is an elevational view from an end of the door handle mechanism shown in FIG. 1.

Handle 12, best shown in FIG. 3, is an elongated body having a central portion thereof forming a grip 20 intermediate a first end 22 configured for pivotally connecting handle 12 to base 16 and a second end 24 configured for connecting handle 12 to latch lever 14. First end 22 includes a receiver 26 for receiving a post (not shown) or other structure of base 16 about which handle 12 can pivot on a handle axis designated as numeral 28 in the drawings. Other pivotal connections of handle 12 to base 16 also can be used. In the installed orientation of the embodiment shown, handle axis 28 is substantially vertical.

Second end 24 of handle 12 includes a handle arm 30 that extends inwardly in the automobile door. Handle arm 30 includes a post 32 and a distal flange 34 projecting laterally from an end of handle arm 30. A handle rib 36 extends laterally from post 32 at a location intermediate ends of post 32.

Latch lever 14 includes a main body 40 forming a counterweight for operation of lever 14. Connecting arms 42, 44 are provided near opposite ends of body 40 and define holes 46, 48, respectively, therein. A pin 50 extends between and through holes 46 and 48, and is received in holes 52 of base 16 outwardly of connecting arms 42, 44. Since only a fragment of base 16 is shown, only one hole 52 therein is shown, in a portion of base 16 adjacent connecting arm 42. One end of pin 50 is shown in hole 52. However, it should be understood that an additional portion (not shown) of base 16 defines a similar hole 52 adjacent connecting arm 44 for receiving an opposite end of pin 50. Pin 50 received in connecting arms 42, 44 and base 16 thereby defines a lever axis 54 about which latch lever 14 can pivot. Other pivotal connections of latch lever 14 to base 16 also can be used. In the installed orientation of the embodiment shown, lever axis 54 is substantially horizontal, near an upper portion of latch lever 14 such that a substantial portion of body 40 is below lever axis 54.

Latch lever 14 further includes a cable arm 56 extending from body 40. Cable arm 56 defines a slot 58 therein by which an enlarged end of a cable (not shown) can be connected to, for operation by latch lever 14. Cable arm 56, and particularly slot 58 is outwardly of and below lever axis 54 so that rotation of latch lever 14 about lever axis 54 raises slot 58 to pull a cable held thereby.

A lever arm 60 of latch lever 14 extends upwardly from body 40, above lever axis 54 and toward handle arm 30. Lever arm 60 and handle arm 30 overlap along portions at the ends thereof. Movement of handle arm 30 generally outwardly with respect to a door in which it is installed engages distal flange 34 against lever arm 60, causing movement thereof with further movement of handle 12. Latch lever 14 is thereby caused to pivot about lever axis 54 in an unlatch direction indicated by arrow 62.

A protrusion or rib 64 projects laterally from lever arm 60 in a direction toward post 32 and rib 36, which is on a side of post 32 facing lever arm 60. Protrusion 64 and rib 36 are in close proximity to each other, with rib 36 being in the rotational path of protrusion 64 in unlatch direction 52.

A spring 70 is disposed around pin 50, between connecting arms 42 and 44. Ends 72 and 74 of spring 70 are disposed against latch lever 14 and base 16, to bias rotation of latch lever in a direction opposite to unlatch direction 62.

During normal use of door handle mechanism 10, grip 20 is held and pulled to unlatch the door. Handle 12 pivots about handle axis 28, causing second end 24 to move outwardly, along with handle arm 30. As handle arm 30 moves outwardly, distal flange 34 engages lever arm 60. Movement of lever arm 60 pivots latch lever 14 about lever axis 54 in unlatch direction 62. Cable arm 56 is moved upwardly, pulling a cable (not shown) connected to slot 58, thereby unlatching the door.

If a side-impact event occurs on the side of the automobile opposite to the side on which door handle mechanism 10 is installed, the force from the impact can cause latch lever 14 to rotate about lever axis 54 in unlatch direction 62. A side impact of significant force can cause rotation of latch lever 14 sufficient to unlatch the door, even though handle 12 is not moved. However, in a door handle mechanism 10 of the present invention, movement of lever arm 60 is restricted, reducing the potential for unintended opening of a door on which mechanism 10 is installed.

If handle 12 is not moved, and latch lever 14 is forced to rotate about lever axis 54 in unlatch direction 62, after only minimal rotation protrusion 64 encounters rib 36. Further rotation of latch lever 14 is thereby inhibited. Neither rib 36 nor protrusion 64 interferes with normal operation of handle mechanism 10, initiated by pulling grip 20.

The anti-rotation feature of rib 36 on handle arm 30 overlapping protrusion 64 of lever arm 60 in unlatch direction 62 can be added to known handle mechanism designs without substantial redesign of the mechanism. Both the handle and latch lever can be made by cost efficient casting methods. The feature can be added as integral modifications to the parts, requiring no increase in the number of parts and no additional assembly steps.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An automobile door handle mechanism comprising:

a door handle having a handle arm;

a latch lever having a lever arm engaged with said handle arm for movement of said latch lever by movement of said handle;

a substantially horizontal lever axis about which said latch lever moves, said latch lever having a cable arm and a cable slot below said lever axis; and a rib on said handle arm and a protrusion on said lever arm restricting movement of said latch lever about said lever axis without movement of said handle.

2. The door handle mechanism of claim 1, said lever arm extending above said lever axis.

3. An automobile door handle mechanism comprising:

a door handle having a handle arm;

a latch lever having a lever arm engaged with said handle arm for movement of said latch lever by movement of said handle;

a lever axis about which said latch lever moves; and a rib on said handle arm and a protrusion on said lever arm restricting movement of said latch lever about said lever axis without movement of said handle, said lever arm protrusion having a rotational path in an unlatch direction, and said rib on said handle arm being disposed in said rotational path.

4. An automobile door handle mechanism comprising:

a door handle having a handle arm;

a latch lever having a lever arm engaged with said handle arm for movement of said latch lever by movement of said handle;

a lever axis about which said latch lever moves; and a rib on said handle arm and protrusion on said lever arm restricting movement of said latch lever about a lever axis without movement of said handle said latch lever having a cable arm on one side of said lever axis, and said lever arm extending toward said handle arm on a side of said pivotal axis substantially opposite said cable arm.

5. An automobile door handle mechanism comprising:

a handle mechanism base;

a handle pivotally connected to said base about a handle axis;

a latch lever pivotally connected to said base about a lever axis said latch lever moving in a path from a latch position to an unlatch position;

said handle including a handle arm;

said latch lever including a lever arm engaged with said handle arm for movement of said latch lever upon movement of said handle; and said handle and said lever arm configured and engaged to inhibit rotation of said latch lever without movement of said handle, including a position of said handle disposed in said path between a portion of said latch lever and said unlatch position, for blocking movement of said latch lever to said unlatch position.

6. The handle mechanism of claim 5, said handle axis being near one end of said base and said lever axis being near an opposite end of said base.

7. The handle mechanism of claim 5, said lever axis being substantially horizontal.

8. The handle mechanism of claim 7, said handle axis being substantially vertical.

9. The handle mechanism of claim 7, said lever arm extending above said substantially horizontal lever axis.

10. The handle mechanism of claim 9, including a spring biasing said latch lever toward a latched position.

11. The handle mechanism of claim 9, said latch lever including a cable arm defining a slot for holding a cable below said lever axis.

12. The handle mechanism of claim 5, said handle axis being substantially vertical.

13. The handle mechanism of claim 5, said lever arm having a laterally extending protrusion moved in a path in an unlatch direction, and said handle arm having a laterally extending rib disposed in said path in said unlatch direction.

14. An automobile door handle mechanism comprising:

a handle mechanism base;

a handle pivotally connected to said base about a handle axis;

a latch lever pivotally connected to said base about a lever axis;

said handle including a handle arm;

said latch lever including a lever arm engaged with said handle arm for movement of said latch lever upon movement of said handle;

said handle arm and said lever arm configured and engaged to inhibit rotation of said latch lever without movement of said handle; and a rib on said handle arm and a protrusion on said lever arm, said rib and said protrusion engaging to inhibit rotation of said lever without movement of said handle, said rib of said handle being disposed in the rotational path of the lever arm.

15. An automobile door handle mechanism comprising:

a door handle having a handle arm;

a latch lever rotatable in an unlatch direction to unlatch a door, said latch lever having a lever arm engaged with said handle arm for rotation thereof in said unlatch direction by movement of said handle; and said handle arm at least partly overlapping said lever arm in said unlatch direction for restricting movement of said latch lever in said unlatch direction without movement of said handle.

16. The door handle mechanism of claim 15, said handle arm having a protrusion overlapping a portion of said latch lever in said unlatch direction.

17. The door handle mechanism of claim 15, said latch lever having a protrusion overlapped by said handle arm in said unlatch direction.

* * * * *